US006132059A

United States Patent [19]

Leibowitz

[11] Patent Number: 6,132,059

[45] Date of Patent: Oct. 17, 2000

[54] SATCHEL WITH ILLUMINATED DISPLAY

[76] Inventor: Neil S. Leibowitz, No. 5, 7F., Lane 116, Da-An Road, Section 1, Taipei, Taiwan

[21] Appl. No.: 09/305,089

[22] Filed: May 4, 1999

[51] Int. Cl.[7] ..... A45C 15/06

[52] U.S. Cl. ..... 362/156; 362/154; 362/812

[58] Field of Search ..... 362/184, 154, 362/155, 156, 812; 206/232, 459.5; 150/103, 112, 117; 40/575, 576

[56] References Cited

U.S. PATENT DOCUMENTS

| | | | |
|---|---|---|---|
| 2,523,129 | 9/1950 | Maier | 150/112 |
| 5,067,063 | 11/1991 | Granneman et al. | 362/156 |
| 5,908,232 | 6/1999 | Burns et al. | 362/156 |

*Primary Examiner*—Y. Quach

*Attorney, Agent, or Firm*—Harold L. Novick; Nath & Associates

[57] ABSTRACT

An improved satchel with illuminated display comprising a sack having walls which define an interior space within the sack. The sack has a display-holder permanently fixedly attached to the outside of the sack. The display-holder has a display-receiving pocket as well as a passage between the display-receiving pocket and the interior space within the sack. This permits a display to be easily taken in and out of the display-holder. Since the display-holder is accessible solely from the interior space within the sack there is a great deal of security. The sack also has a display within the display-holder and a number of electric light sources which can be flashed or turned on to illuminate the display. The satchel carries its own source of electrical current.

3 Claims, 4 Drawing Sheets

SATCHEL WITH ILLUMINATED DISPLAY

FIELD OF THE INVENTION

This invention relates in general to a satchel, and relates in particular to an improved satchel with a display which in one embodiment can be an illuminated display.

BACKGROUND OF THE INVENTION

Satchels having an interior compartment for containing items, such as back packs, purses, attache cases, luggage and other containers, whether closable or not, are well known in the art. Also, satchels having displays mounted thereon are well known in the art. Many airline companies require that checked pieces of luggage have an attached display giving at least the name of the owner or user of the satchel. Such a display is commonly referred to as a luggage tag. These luggage tags are frequently attached to the satchel only by an easily removable strap and buckle. Other displays include such items as national flags; the logos of affinity groups, corporations, or other business entities; and even political statements.

Unfortunately, these known satchels with displays suffer from a number of disadvantages. For example, the display can be easily removed by accident or by design. A thief seeking to remove a luggage tag, need only unbuckle the buckle, remove the tag from the satchel and walk away with the satchel. If the display on the satchel be a political statement, such can be removed by any individual having a contrary political view.

Another disadvantage is that many of the prior displays are not easily changeable. These displays are attached permanently to the satchel by means such as by sewing or by silk-screen printing directly on the material of the satchel. Unfortunately the displays cannot be varied at the will of the user of the satchel. They can not be changed or modified conveniently.

A further disadvantage of the prior displays are that they are not sealed from the elements. Thus, water or wind can penetrate the display container and damage the display.

Many individuals of both sexes, who are either in fact young or young at heart, have an unfulfilled desire to call attention to the display on their satchel, such as with flashing lights, or to make the display readable at night by illuminating the display. In the past this was commonly done by means of a hand-held light source such as a flashlight.

In the past, considerable efforts have been expended to prevent purposeful or accidental damage to such satchels and their displays. Unfortunately, these efforts have frequently resulted in making it difficult for the user of the satchel to change the display.

Examples of known satchels with displays include those described in U.S. Pat. No. 5,431,317 (1995) and U.S. Design Pat. No. 399,053 (1998).

SUMMARY OF THE INVENTION

Accordingly it is an object of the present invention to provide an improved carrying case of any kind, herein generalized as a satchel, that is substantially free of one or more of the disadvantages of prior satchels. In general and without limitation, it is an object of the present invention to provide a mechanism to call attention to a satchel, to increase the night time safety of the user carrying a satchel, and to provide a way to personalize and decorate a satchel.

Another object is to provide an improved satchel wherein the display can be illuminated at the option of the user of the satchel.

Still another object is to provide an improved satchel having an illuminated display casing which can be removably or permanently, sealably mounted on a satchel and not easily removed or damaged by accident or by design.

Yet another object is to provide an improved satchel with an illuminated display wherein the display can be easily and conveniently changed only by the user of the satchel.

Additional objects are to provide an improved satchel with an illuminated display-holder that can carry a display wherein the changing of the display can be accomplished only from inside the satchel, and wherein the display is protected from the environmental elements such as moisture, water, wind and dirt.

Another object is to provide an improved satchel wherein the user can call attention, at will, to the display on the satchel by illuminating it.

The above and other objects are accomplished in accordance with the present invention by providing an improved satchel with illuminated display as described in the following description and drawings.

According to one embodiment of the present invention, there is provided an improved satchel having an illuminated display as depicted in the several views in which like numerals represent like elements throughout the several views. The satchel comprises a sack having walls defining a bottom and a closable top. The walls are generally of a planar material which is preferably flexible. The material has an inwardly-facing planar surface and an outwardly-facing planar surface. The walls define an interior space within the sack whereby the inwardly-facing planar surface faces toward the interior space, and the outwardly-facing planar surface faces away from the interior space.

The improved satchel also comprises a display-holder that in one embodiment can be removably mounted to a flexible material that forms the walls of a satchel, and in another embodiment can be permanently, fixedly attached to the flexible, planar material. This display-holder has (1) an interior display-receiving pocket, and (2) a passage between the display-receiving pocket and the interior space within the sack. This passage permits a display to be placed in and/or removed from the display-holder. This can, however be done solely from the interior space within the sack. In the vast majority of cases, access to the interior space is controlled by the person using the satchel.

DETAILED DESCRIPTION OF THE PREFERRED EMBODIMENTS

Figure 1:
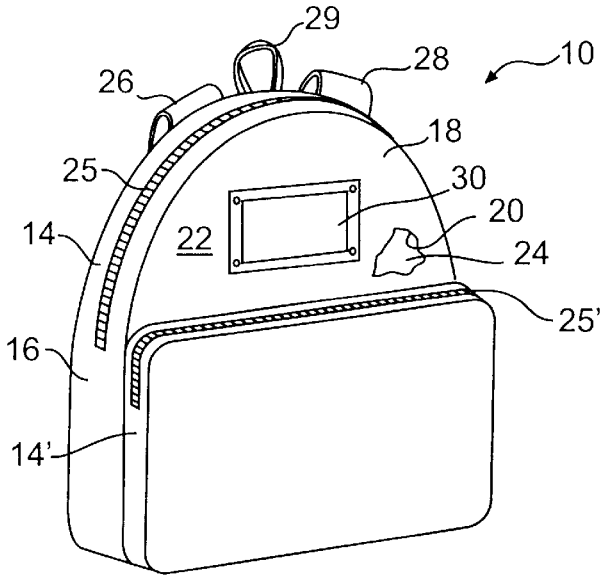
FIG. 1 is a perspective view of a satchel of the present invention having an illuminated display-holder having a display therein, and with a portion of the satchel cut away so as to depict the interior thereof.
Figure 2:
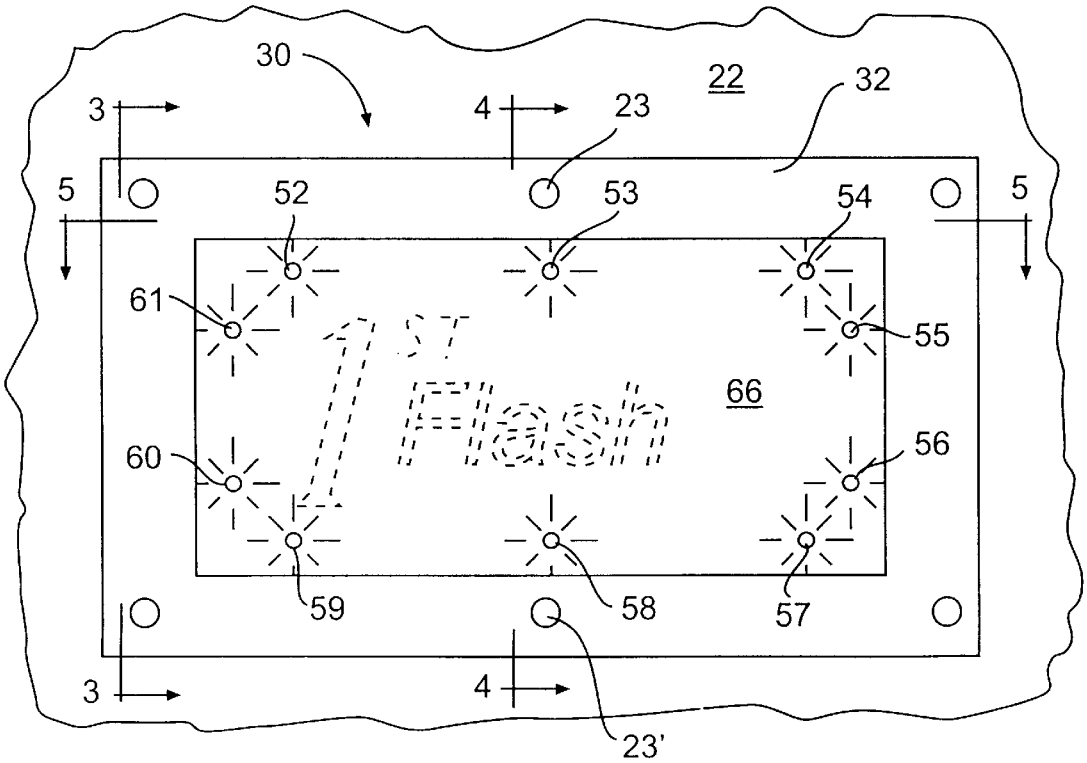
FIG. 2 is an enlarged view of the illuminated display-holder.

Referring now to the drawings in general and in particular to FIGS. 1 and 2 there is shown an improved satchel of the present invention in the form of a back pack 10 having a display-holder 30.

Back pack 10 comprises a sack 14 having walls 16, 18 of a flexible, planar material. The material has an inwardly-facing planar surface 20 and an outwardly-facing planar surface 22 (see also FIG. 3). Walls 16, 18 define an interior space 24 within sack 14 that can be sealed by a conventional, top closure means such as disclosed zipper 25. Other closure means are well known in the art and can include for example overlapping panels that have a Velcro-type fastening mechanism, buckles or straps, and a resilient trough and tongue combination, such as is conventionally found on plastic bags. Inwardly-facing planar surface 20 of the planar material faces toward interior space 24 within sack 14. Conversely outwardly-facing planar surface 22 of the planar material faces away from interior space 24 within sack 14.

Also as shown in FIG. 1, back pack 10 includes a second sack 14' mounted outside sack 14 and separately closeable by a second closure means such as zipper 25'.

Back pack 10 carries a pair of conventional shoulder straps 26, 28 in order to easily carry back pack 10 on the back of a user. Back pack 10 also has a handle 29 so that it can be carried by a single hand of a carrier.

Figure 4:
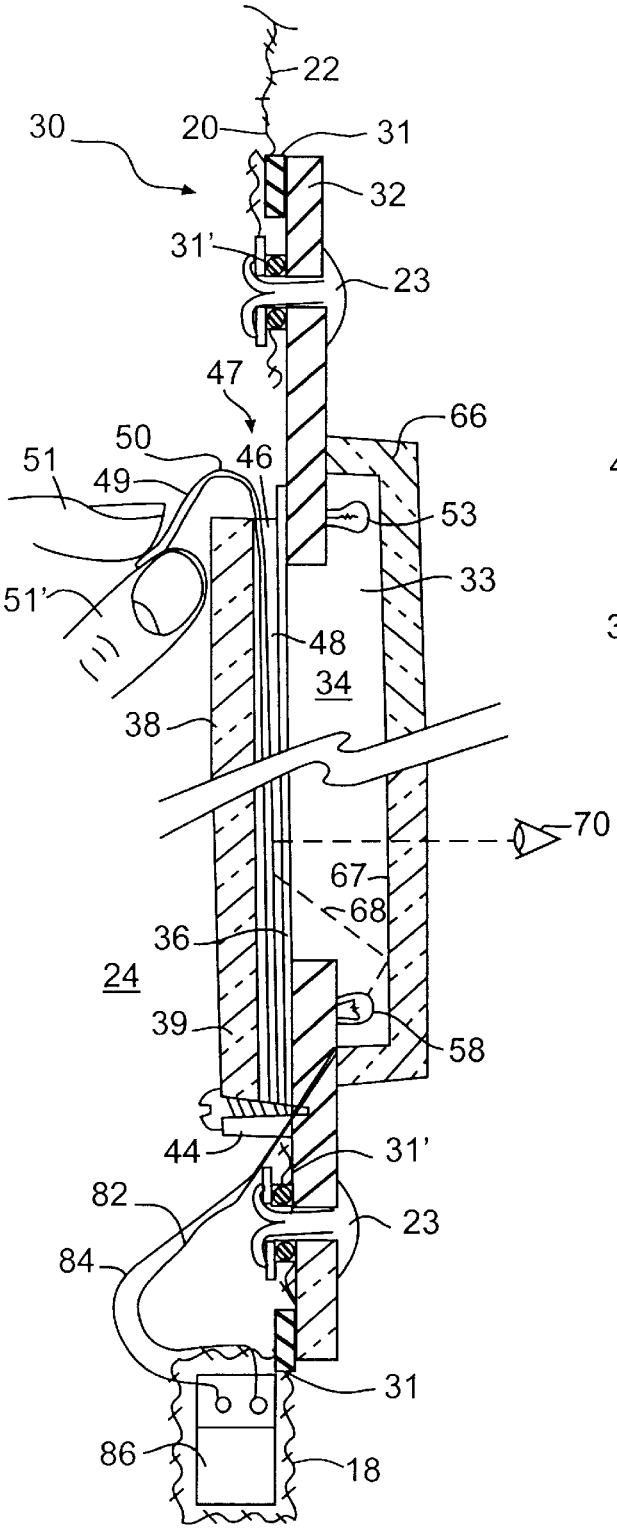
FIG. 4 is a cross-sectional view on a greatly enlarged scale of the display-holder useful in the present invention taken along line 4—4 of FIG. 2.
Figure 3:
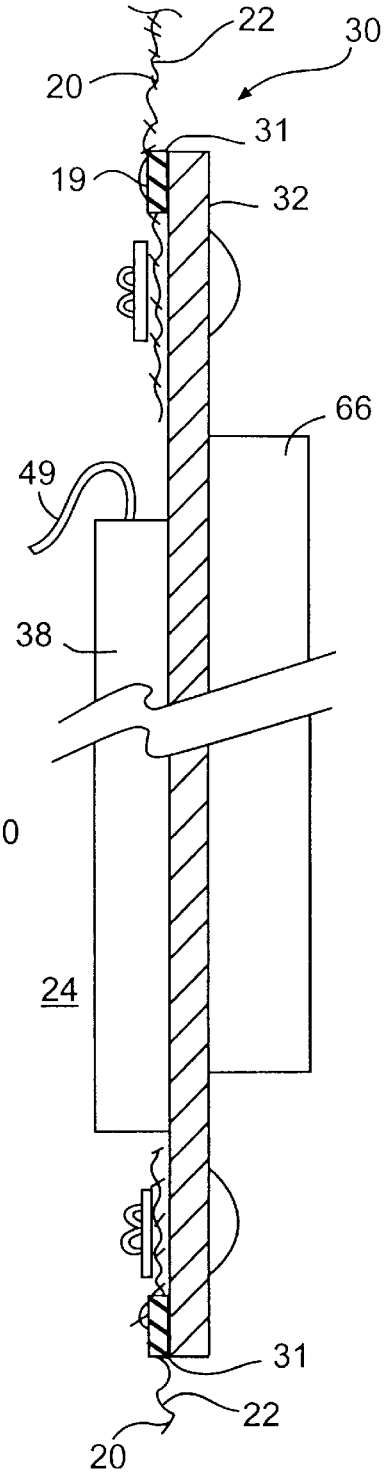
FIG. 3 is a cross-sectional view on a greatly enlarged scale of the display-holder useful in the present invention taken along line 3—3 of FIG. 2.
Figure 5:
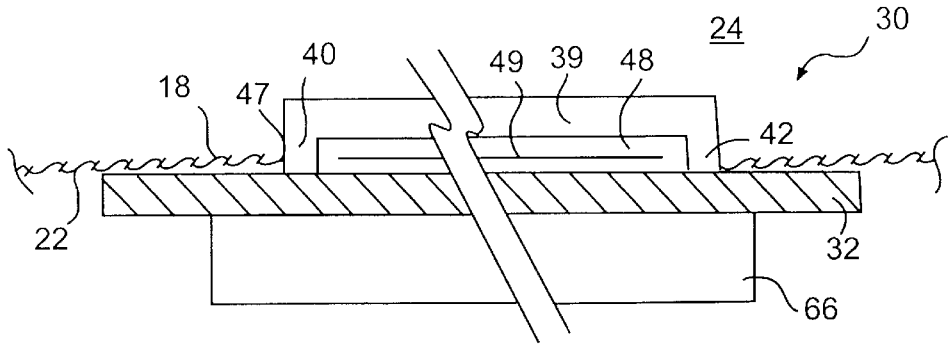
FIG. 5 is a cross-sectional view on a greatly enlarged scale of the display-holder useful in the present invention taken along line 5—5 of FIG. 2.

Referring now to FIGS. 3, 4, and 5, it can be seen that back pack 10 of the present invention also has a display-holder 30 permanently, fixedly attached to wall 18 by any convenient means such as by rivets 23, 23' and sealed with a water-tight seal 31 to outwardly-facing planar surface 22 of wall 18. Seal 31 can be a filler material, such as a silicon adhesive, or can be a gasket made of conventional gasket material. If a rivet or similar fastener is used to attach display-holder 30 to wall 18, then a sealant material, such as shown in FIG. 4 at 31', can be used to seal this area. Other attachment means can comprise adhesives, stitches, and staples. A removable attachment means could include screws and nuts. Filler 31 is any conventional sealant that is located between the material and display-holder 30 and provides a water-tight and, if desired, an air tight seal, and can also include a conventional rubber-based compound. Also, filler 31 can be a conventional insulating or "rubber" gasket which could be used in combination with a removable attachment means.

Display-holder 30 comprises an annular attaching frame 32 having a central opening 33 therein that provides an open viewing port 34 central within frame 32. Display-holder 30 contains a removable display 49. As explained more completely below, the height and width of port 34 is significant. Port 34 has a given height "hp", and a given width "wp".

Display-holder 30 further comprises a transparent protecting sheet 36 whose dimensions are also significant. Sheet 36 has a given height "hs", and a given width "ws". In accordance with this preferred embodiment of the present invention, the height "hs" of sheet 36 is greater than the height "hp" of port 34. Furthermore the width "ws" of sheet 36 is greater than the width "wp" of port 34. Because of this relationship, sheet 36 completely covers port 34. This prevents display 49 from contacting and damaging any light source or any other parts of display-holder 30. Because sheet 36 is wider than the width of retainer 38, sheet 36 is held fast to frame 32, thereby providing a smooth surface for insertion of display 49 or any other display.

Display-holder 30 also has a substantially planar display retainer 38 having a flat back wall 39 carrying a left side rim 40, a right side rim 42 and a bottom rim 44. The presence of back wall 39 and rims 40, 42, 44, provides an open top 46. Open top 46 projects through an opening 47 in wall 18 into interior space 24 of sack 14.

Rims 40, 42, 44 together with flat back wall 39, define an interior display-receiving pocket 48 adapted to receive a display 49 placed in display-receiving pocket 48 through open top 46. In accordance with the present invention, a display 49 is in display-receiving pocket 48. The height of display 49 is greater than the depth of pocket 48. Display 49 contains a fold 50, permitting display 49 to be easily removed by finger 51 and thumb 51'. The indicia on display 49 is: "1$^{st}$ Flash", but can be anything.

In the preferred embodiment represented by back pack 10 there is provided a passage between display-receiving pocket 48 and interior space 24 within sack 14. This passage is made up of open top 46 of display-holder 30 and an opening 47 in the flexible, planar material. This structure permits display 49 to be placed in display-holder 30 and/or removed from display-holder 30 solely from interior space 24 within sack 14. Since the individual utilizing back pack 10 will have control over interior space 24, that individual will be able to prevent tampering with display 49.

Display-holder 30 also has a number of electric light sources 52, 53, 54, 55, 56, 57, 58, 59, 60, 61, each connected in parallel, as well as means for energizing them by supplying electrical current to them in order to light them. Electric light sources 52, 53, 54, 55, 56, 57, 58, 59, 60, 61 are part of an electric circuit 80, described below.

The light sources 52, 53 etc. are covered with a cover 66, the inside surface 67 of which reflects light rays such as the light ray 68. The light ray 68 and other light rays from the sources 52, 53, etc. illuminate the display 49 making it readily visible, even in dim light, to the eye 70 of an observer (not shown).

Figure 6:
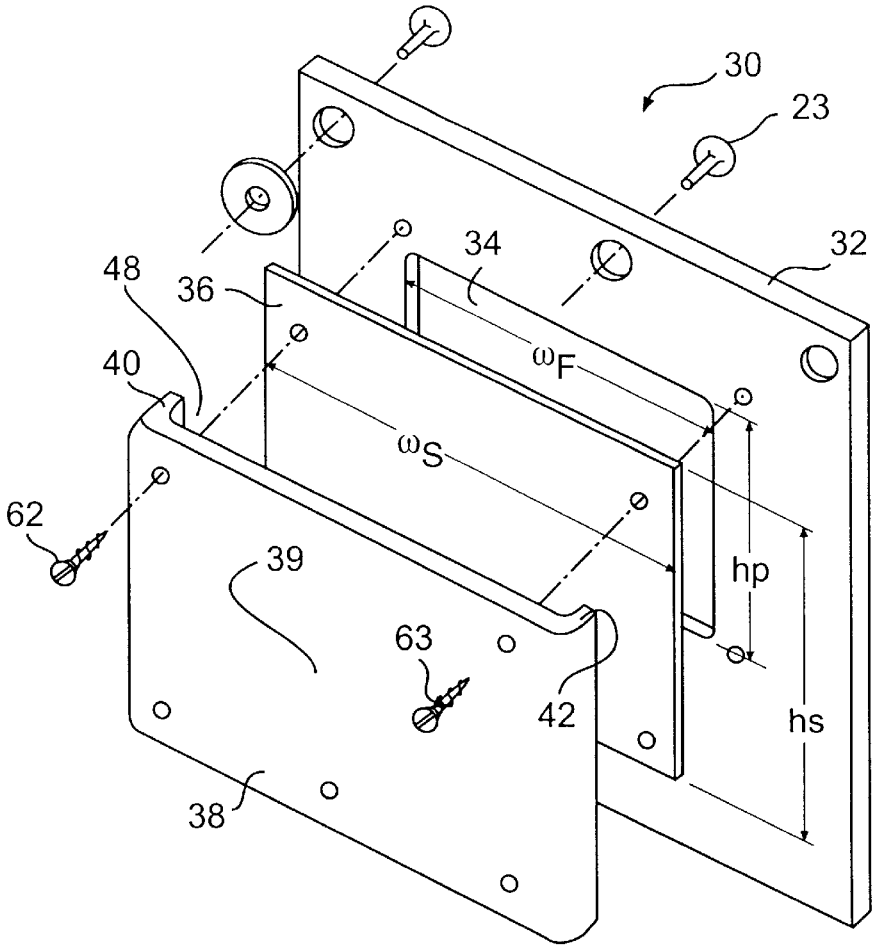
FIG. 6 is an exploded perspective view of a portion of the display-holder useful in the present invention of FIGS. 2 through 5.

Referring now to the exploded view that is FIG. 6, it can be seen how the retainer 38 holds the sheet 36 tightly against the frame 32 by means of screws such as the screws 62, 63. In can also be seen that the sheet 36 completely covers the port 34. Furthermore, the sheet 36 prevents the display 49 from passing through the port 34, thus ensuring that all light sources and other circuit elements are protected from damage when inserting a display 49 into the display-receiving pocket 48.

Figure 7:
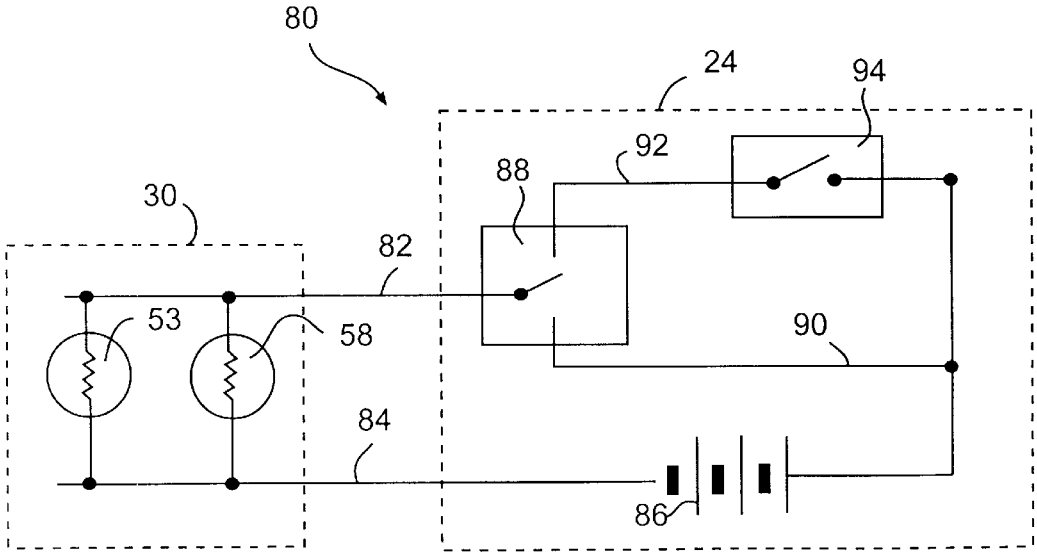
FIG. 7 is an electrical schematic circuit diagram of the components by which the display of the present invention is illuminated.

Referring now to FIG. 7, there is shown the circuit 80 comprising a pair of conductors 82, 84 and at least one dry cell 86 for impressing a voltage between the conductors 82, 84. In this manner, electrical current is supplied to the conductors 82, 84. The circuit 80 also comprises a selector switch 88 for causing current to optionally flow through a conductor 90, or a conductor 92 or not at all. A suitable selector switch 88 is that supplied by the organization called "Wealth Metal Factory, Ltd."; Flat G; 4/F Phase 4; Kwun Tong Industrial Center; 436-446 Kwun Tong Road, Kowloon, Hong Kong, as part number "SS-12F21". The conductors 82, 84 are parallel to each other but are both in series with the dry cell 86. In series with the conductor 92 is an automatic interrupter 94 for periodically interrupting the flow of current in the circuit 80. The interrupter 94 is available from the Chip Design Tech Organization of Taipei, Taiwan, as stock number CDT 3258. This interrupter 94, when in the circuit, can cause the light sources, such as the LEDs 52, 53 to flash. By virtue of the design of the circuit 80, the user of the back pack 10 can utilize the selector switch 88 to cause the light sources, such as the LEDs, 52, 53 to flash, or to be steadily lit or to be turned off. When lit, the light sources, such as the LEDs, 52, 53 permanently or periodically illuminate the display 49.

It will be understood that all LEDs 52, 53, 54, 55, 56, 57, 58, 59, 60, 61 are part of the circuit 80 even though only LEDs 53 and 58 are shown in FIG. 7.

Figure 8:
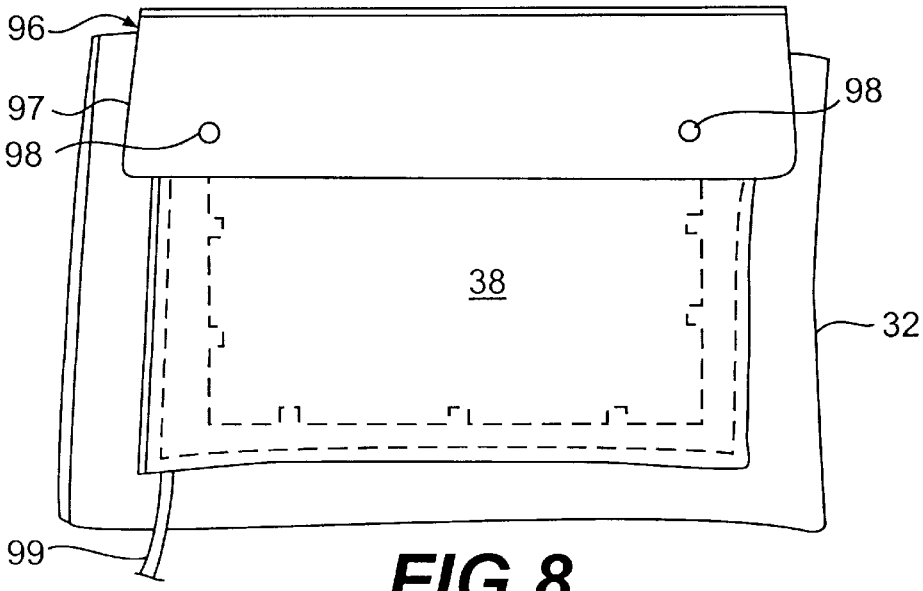
FIG. 8 is an elevational view of a second embodiment of the present invention, looking at the inwardly facing surface of the satchel wall, and depicting a cover for the display-holder.

With reference now to FIG. 8, a second embodiment of the present invention is depicted. In this embodiment, pocket 48, has a covering 96, which in the embodiment of FIG. 8, is comprised of a fabric cover 97 fixedly attached at one end to the top of frame 32 by means such as an adhesive and conventional snap fasteners 98 located at the distal end of cover 97. FIG. 8 also depicts a cable 99 that contains conductors 82 and 84 (shown in FIG. 7).

There has thus been described and depicted a display-holder that is permanently fixedly attached to a sack of a satchel by any convenient means such as adhesive, glue, or the presently preferred rivets.

The described and depicted satchel of the present invention includes a display within a display-holder, and an electric light source carried by the display-holder. Associated with the display of the satchel, is a means for energizing this light source thereby illuminating the display.

The electric light source can be any source which emits electromagnetic radiation within the visible spectrum. Examples of suitable sources include, incandescent bulbs, fluorescent tubes, and light emitting diodes, commonly called "LEDs". LEDs are the preferred light source because of cost, convenience, ease of manufacture, and the small amount of electric current that they draw when energized. This small amount of electric current produces illumination for a longer period of time than a light source which takes a greater amount of current when using a source of electric power which is finite such as a dry cell. In other words a given dry cell will produce illumination longer if the current is less.

The satchel of the present invention can be any portable satchel for carrying and safeguarding personal effects. Examples of such satchels include among others: a back pack, a hand bag, a shoulder bag, a brief case, an attache case, a tote bag, a sports bag, a diaper or baby bag, or a piece of luggage. The satchel of the present invention can be equipped with a handle and/or one or more shoulder straps and can be capable of being closed by means such as a zipper. Also, the satchel can be of any shape besides the disclosed presently preferred rectangular shape in cross-section. In this regard, the shape of walls 16 and 18 need not be planar, but can be arcuate, or even spherical in the case of a spheroidal or quasi-spheroidal shape that for example a bowling ball bag would have. A particularly preferred embodiment is that wherein the satchel is a back pack with a pair of shoulder straps.

A wide variety of flexible, planar materials can be used to construct the satchel of the present invention. In fact any material used for the construction of satchels in the past can be used to construct the satchel of the present invention. Suitable flexible materials include among others: woven and non-woven cloth from a wide variety of natural fibers such as those of cotton, flax or wool; synthetic fibers such as those of poly esters, polyamids and acrylics; leather from the skin of mammals such as cows or goats, reptiles such as snakes or alligators; artificial leather such as that produced from an organic thermoplastic such as poly(vinyl chloride) commonly referred to as "PVC" or simply "vinyl". Such material can be waterproof.

As described herein, at least certain parts of the display-holder must be constructed of a material that is at least translucent and preferably transparent. Examples of suitable materials include the translucent organic thermoplastics such as polyethylene, polypropylene, acrylics, and polycarbonate. The preferred acrylic is poly (methyl methacrylate), which is available from a wide variety of sources such as from the Dupont Company of Wilmington, Del., USA, under the trade name "Plexiglas". Polycarbonate is available from the General Electric Company of Schenectady, N.Y., USA, under the trade name "Lexan". The preferred material for the holder is polycarbonate because of its great strength, its impact resistance and its resistance to degradation by ultra violet light.

The shapes of display-holder 30 and of the corresponding display 49 in the present embodiment is rectangular, but other shapes are possible. Thus, the shapes can be circular, ovular, triangular, trapezoidal, hexagonal or other polygonal shape.

In the satchel of the present invention, the means for lighting the electric light source can be either alternating or direct current, but is preferably direct current. The voltage can be any voltage high enough to light the light source but sufficiently low to avoid the risk of electric shock. The voltage can be from 0.1 to 40 volts, but is preferably from 1.5 to 12 volts. The voltage and therefore the electric current can be supplied from any convenient source such as a dry cell or a lithium dry cell that are mounted in an interior pocket inside the satchel or a solar cell or a small generator driven by the wind or by hand, mounted on the outside of said satchel and connected by wires to the light source. A nine volt lithium dry cell is the preferred power source.

Since the function of the display is to convey information and to be decorative, it can carry a wide variety of materials such as a logo; a photograph, artwork which can be computergenerated or produced by hand or by any other means; or indicia. The indicia can be the letters of an alphabet or other symbols of writing believed to be understood by an observer.

Although the invention has been described in considerable detail with respect to certain preferred embodiments thereof, it will be understood that variations are within the skill of the art without departing from the spirit of the invention as described above and as defined in the appended claims.

What is claimed is:

1. A satchel having an illuminated display wherein said satchel includes:

A. at least a first sack having walls of a flexible, planar material, said material having a first planar surface and a second planar surface; wherein:
   (1) the sack has an open, closable top; and
   (2) said walls define an interior space within the sack whereby the first planar surface of the planar material faces toward the interior space within the sack;

B. a display-holder permanently fixedly attached to the flexible, planar material and the display being carried by the display-holder; said display-holder having:
   (1) an interior display-receiving pocket; and
   (2) a passage between the display-receiving pocket and the interior space within the sack; thus permitting the display to be placed in the display-holder and removed from the display-holder solely from the interior space within the sack;

C. an electric light source carried by the display-holder;

D. means for energizing the electric light source thereby illuminating the display.

2. The satchel of claim 1 wherein the flexible, planar material is a member selected from a group consisting of leather, woven cloth, organic thermoplastic, and poly(vinyl chloride).

3. A backpack having an illuminated display wherein said backpack includes:

A. at least a first sack having walls of a flexible, planar material with a bottom and an open top which is closable, said material having a first planar surface and a second planar surface; wherein:

(1) said walls define an interior space within the sack whereby the first planar surface of the planar material faces toward the interior space within the sack;

B. a pair of shoulder straps and a handle carried by the sack;

C. a display-holder permanently fixedly attached to the flexible, planar material and the display being carried by the display-holder; said display-holder comprising:

(1) an attaching frame;

(2) an open viewing port central within the attaching frame wherein the open viewing port has a given height "hp", and a given width "wp";

(3) a transparent protecting sheet wherein the transparent protecting sheet has a given height "hs", and a given width "ws"; wherein:

"hs" is greater than "hp"; and

"ws" is greater than "wp";

whereby the transparent protecting sheet completely covers the open viewing port;

(4) a substantially planar display retainer connected to the attaching frame and having a flat back wall carrying a left side rim, a right side rim and a bottom rim, thus leaving an open top which open top projects into the interior space of the sack;

wherein the rims, together with the flat back wall, define an interior display-receiving pocket adapted to receive the display placed in the display-receiving pocket through the open top of the display-holder;

D. a passage between the display-receiving pocket and the interior space within the sack; thus permitting the display to be placed in the display-holder and removed from the display-holder solely from the interior space within the sack;

E. a plurality of electric light emitting diodes each connected in parallel, carried by the display-holder;

F. means for energizing the light emitting diodes, said means constituting an electric circuit comprising a pair of conductors connected in parallel between the conductors and the light emitting diodes; at least one dry cell for impressing a voltage between the conductors and thereby supplying electrical current to the conductors; a selector switch for causing current to optionally flow through a conductor in series with the dry cell or through a parallel conductor having, in series, an automatic interrupter for periodically interrupting the flow of current in the circuit, thereby at least periodically illuminating the display.

* * * * *